US005931020A

United States Patent [19]

Nakamura

[11] Patent Number: 5,931,020

[45] Date of Patent: Aug. 3, 1999

[54] REFRIGERANT EVAPORATOR HAVING A PLURALITY OF TUBES

[75] Inventor: Tomohiko Nakamura, Nagoya, Japan

[73] Assignee: Denso Corporation, Kariya, Japan

[21] Appl. No.: 09/032,683

[22] Filed: Feb. 26, 1998

[30] Foreign Application Priority Data

Feb. 28, 1997 [JP] Japan ..... 9-046272

[51] Int. Cl.[6] ..... F25B 39/02

[52] U.S. Cl. ..... 62/527; 62/524; 165/146

[58] Field of Search ..... 62/524, 526, 527, 62/509; 165/146, 147, 152, 153, 176

[56] References Cited

U.S. PATENT DOCUMENTS

| | | | |
|---|---|---|---|
| 4,821,531 | 4/1989 | Yamauchi et al. | 62/515 |
| 5,701,760 | 12/1997 | Torigoe et al. . | |
| 5,735,343 | 4/1998 | Kajikawa et al. | 165/153 |
| 5,765,393 | 6/1998 | Schlak et al. | 62/507 |

FOREIGN PATENT DOCUMENTS

U-61-74776 5/1986 Japan .

*Primary Examiner*—Henry Bennett
*Assistant Examiner*—Marc Norman
*Attorney, Agent, or Firm*—Harness, Dickey & Pierce, PLC

[57] ABSTRACT

A refrigerant evaporator constructed by laminating a plurality of tube elements and a flat tube element. A second refrigerant passage in the flat tube element is disposed at a position being closest to a refrigerant outlet pipe. In the second refrigerant passage, some ribs are formed such that the ribs protrude from a flat plate connected to a metal plate to construct the flat tube element. The second refrigerant passage is partitioned into several small refrigerant passages. By this, the refrigerant flow area of the second refrigerant passage is smaller than that of the other refrigerant passages. That is, the refrigerant flow resistance of the second refrigerant passage is larger than that of other refrigerant passages. Accordingly, the refrigerant is prevented from flowing into the second refrigerant passage of the flat tube element.

9 Claims, 6 Drawing Sheets

REFRIGERANT EVAPORATOR HAVING A PLURALITY OF TUBES

CROSS REFERENCE TO RELATED APPLICATION

This application is based on and incorporates herein by reference Japanese Patent Application Nos. Hei. 9-46272 filed on Feb. 8, 1997, and Hei. 10-13944 filed on Jan. 27, 1998.

BACKGROUND OF THE INVENTION

1. Field of the Invention

The present invention relates to a refrigerant evaporator that includes a plurality of laminated tubes constructed from a pair of metal plates to perform a heat exchange between a liquid-gas phase refrigerant introduced from a pressure reducing means and an air flowing outside thereof.

2. Description of Related Art

A refrigerant evaporator 100 having a refrigerant route shown in FIG. 7 is disclosed in Japanese Patent Application No. 8-182307.

The evaporator 100 is constructed from a plurality of tubes and corrugate fins 104 that are laminated in an alternating pattern. In each tube, an air downstream side refrigerant passage 102 and an air upstream side refrigerant passage 103 are formed. Here, an arrow denotes an air flow direction. At both upper and lower ends of the air downstream side refrigerant passage 102, an upper tank portion 106 and a lower tank portion 108 are provided. At both upper and lower ends of the air upstream side refrigerant passage 103, an upper tank portion 105 pipe 109 is connected to the lower tank portion 108, which is disposed at the air downstream side. A refrigerant outlet pipe 110 is connected to the upper tank portion 105, which is disposed at the air upstream side. The refrigerant flows inside the evaporator 100 in accordance with the flowing route: "refrigerant inlet pipe 109→lower tank portion 108→air downstream side refrigerant passage 102→upper tank portion 106 →air downstream side refrigerant passage 102→upper tank portion 105→air upstream side refrigerant passage 103→lower tank portion 107→air upstream side refrigerant passage 103→upper tank portion 105→refrigerant outlet pipe 110".

In the evaporator 100, the liquid phase refrigerant flows in the upper tank portions 105 and 106 in one direction and is distributed into each air downstream side refrigerant passage 102 and air upstream side refrigerant passage 103 by the gravitational force. Thus, the liquid phase refrigerant tends to either flow into the refrigerant passages 102 and 103 disposed at the upstream side of the refrigerant flow, or not to flow into the refrigerant passages 102 and 103 disposed at the downstream side of the refrigerant flow. Also, the refrigerant flowing in the lower tank portions 107 and 108 is distributed into the each refrigerant passage 102 and 103 and flows up inside thereof. The refrigerant flows up inside the refrigerant passages 102 and 103 after it flows inside the lower tank portions 107 and 108 into the downstream side of the refrigerant flow. Thus, the refrigerant tends to flow into the refrigerant passages 102 and 103 disposed at the downstream side of the refrigerant flow with being influenced by the inertia force.

For example, in the evaporator 100, as shown in FIG. 9, the refrigerant flowing in the lower tank portion 107 tends to flow into the refrigerant passages 103*a* disposed at the downstream side of the refrigerant flow, or in the vicinity of the refrigerant outlet pipe 110. That is, an excess amount of refrigerant flows into these refrigerant passages 103*a*. The liquid phase refrigerant cannot be evaporated completely and super-heated in these refrigerant passages 103*a*. Therefore, the temperature of the refrigerant at the outlet of the evaporator 100 becomes low, and a temperature responsive expansion valve decreases the amount of the refrigerant flowing into the evaporator 100. Consequently, the cooling ability of the evaporator 100 becomes reduced.

SUMMARY OF THE INVENTION

An object of the present invention is to provide a refrigerant evaporator that prevents an excess amount of refrigerant from flowing into the refrigerant passage disposed in the vicinity of the refrigerant outlet pipe, and that distributes the refrigerant into the plural refrigerant passages uniformly without reducing its productive performance.

According to the first aspect of the present invention, a rib is formed in at least one of the refrigerant passages disposed in the vicinity of the outlet pipe. Thus, refrigerant flow area in this refrigerant passage is less than that in other refrigerant passages. That is, a refrigerant flow resistance in the refrigerant passage having the rib is larger than that in other refrigerant passages. Therefore, an excess amount of the refrigerant is prevented from flowing into the refrigerant passage disposed in the vicinity of the refrigerant outlet pipe or the refrigerant passage disposed in the downstream side of the refrigerant flow. Accordingly, the refrigerant flowing in the refrigerant passage disposed in the vicinity of the refrigerant outlet pipe can be evaporated completely and become a super-heated gas refrigerant. Particularly, according to the present invention, because refrigerant flow area in this refrigerant passage is decreased by forming the rib on the inside wall surface of the tube, the structure does not require additional elements. Thus, the manufacturing cost is not increased.

According to the second aspect of the present invention, since the rib is formed in a flat metal plate connected to the metal plate that forms the refrigerant passage, the outer shape of the ribbed refrigerant passage can be distinguished from other normal refrigerant passages. Therefore, when the plural tubes are assembled, the ribbed refrigerant passage is easily identified, and thus may be correctly positioned.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

Figure 1:
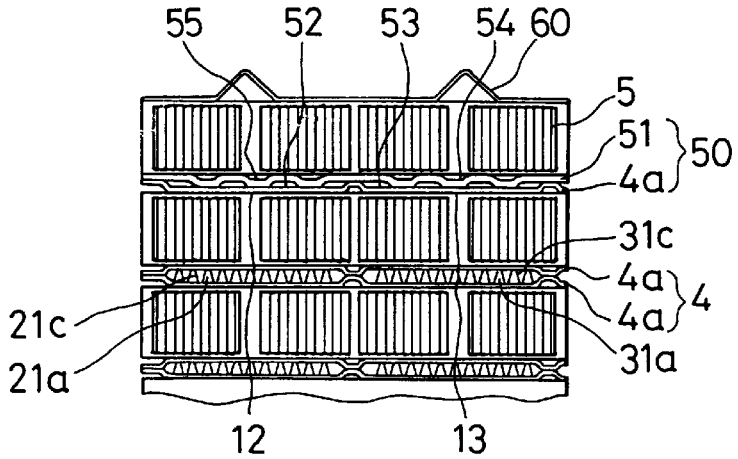
FIG. 1 is a cross sectional view showing a principal part according to the present embodiment.

Referring to the drawings, preferred embodiments of the present invention will be described.

Referring first to FIGS. 1 through 6, an evaporator 1 cools air flowing outside thereof by carrying out a heat exchange between the air and a refrigerant flowing inside thereof. The evaporator 1 is disposed in the cooling unit (not illustrated) of a motor vehicle air conditioning apparatus and includes an air downstream side heat exchanging portion 2 and an air upstream side refrigerant heat exchanging portion 3. The air upstream side heat exchanging portion 3 is arranged at the air upstream side of the air downstream side heat exchanging portion 2.

The air downstream side heat exchanging portion 2 and the air upstream side heat exchanging portion 3 are constructed by a plurality of tube elements 4 and a flat tube element 50 laminated in the direction perpendicular to the air flowing direction. A corrugate fin 5 is disposed in a space between the adjacent tube elements 4, 50 for increasing the heat exchanging efficiency between the refrigerant and the air. At one side of the heat exchanging portions 3 and 4, an end plate 6 and a side plate 7 are provided for reinforcing the heat exchanging portions 3 and 4. At the other side of the heat exchanging portions 3 and 4, an inlet side accumulator 15*a* and an outlet side accumulator 16*a* are provided. The inlet side accumulator 15*a* is connected to a refrigerant inlet pipe 15 which introduces the refrigerant from a pressure reducing member (for example, expansion valve, capillary tube or orifice) into the evaporator 1. The outlet side accumulator 16*a* is connected a refrigerant outlet pipe 16 through which the refrigerant flows from the evaporator 1 to a compressor. The inlet and outlet pipes 15 and 16 extend from the other side of the evaporator 1 to a vehicle engine compartment.

The tube element 4 is formed by a pair of metal plates 4*a* connected to face each other. Each metal plate 4 is made of an aluminum alloy being superior in heat transmitting and press formed into a predetermined shape. Each metal plate 4 has an outer peripheral rib 11 formed at the outer periphery thereof and a center rib 14 partitioning a space surrounded by the outer peripheral rib 11 into first and second I-shaped concave portions 12 and 13. The pair of metal plates 4*a* are connected together at the outer peripheral rib 11 and at the center rib 14 to form the tube element 4.

By connecting the pair of metal plates 4*a* to form the tube element 4, an air downstream side refrigerant passage 21 and an air upstream side refrigerant passage 31 are formed inside the tube element 4. The air downstream side refrigerant passage 21 is formed by the first I-shaped concave portions 12 of the pair of metal plates 4*a* and disposed at the air downstream side of the evaporator 1. The air upstream side refrigerant passage 31 is formed by the second I-shaped concave portions 13 of the pair of metal plates 4*a* and disposed at the air upstream side of the evaporator 1.

The refrigerant flows through the air downstream side refrigerant passage 21 before it flows into the air upstream side refrigerant passage 31. In the air downstream side refrigerant passage 21, a gas-liquid phase refrigerant having lower degree of dryness is evaporated by being heat exchanged with the air flowing outside the evaporator 1. Inside of the air downstream side refrigerant passage 21, an inner fin 21*c* is provided for increasing a heat transmitting efficiency of the refrigerant by spreading the refrigerant in the width direction of the refrigerant passage.

In the air upstream side refrigerant passage 31, a gas-liquid phase refrigerant having higher degree of dryness is evaporated while heat exchanging with the air flowing outside the evaporator 1. Inside of the air upstream side refrigerant passage 31, an inner fin 31*c* is provided for increasing refrigerant heat transmitting efficiency by dispersing the refrigerant in the width direction of the refrigerant passage.

Figure 3:
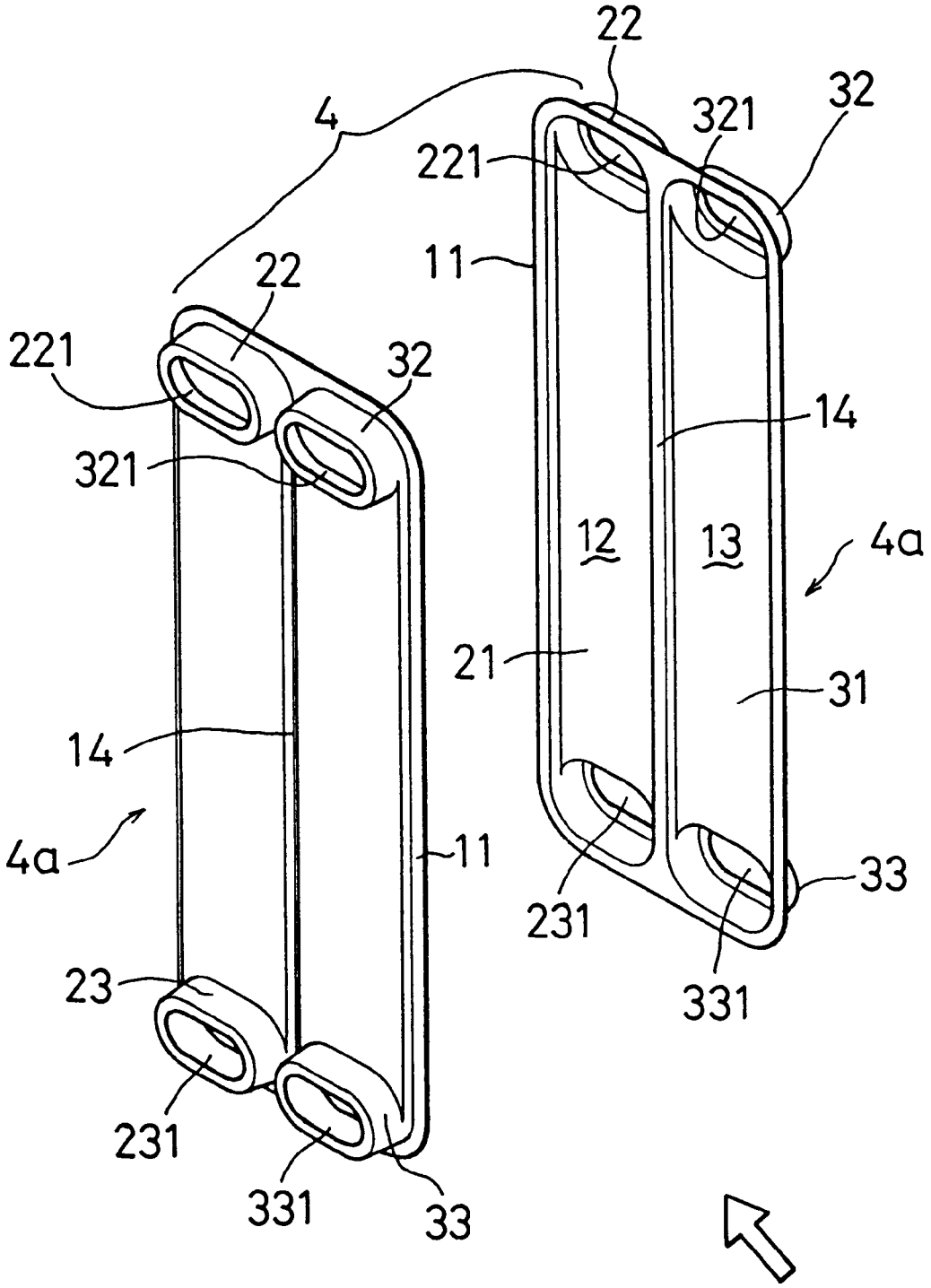
FIG. 3 is a perspective view showing a tube element.
Figure 5:
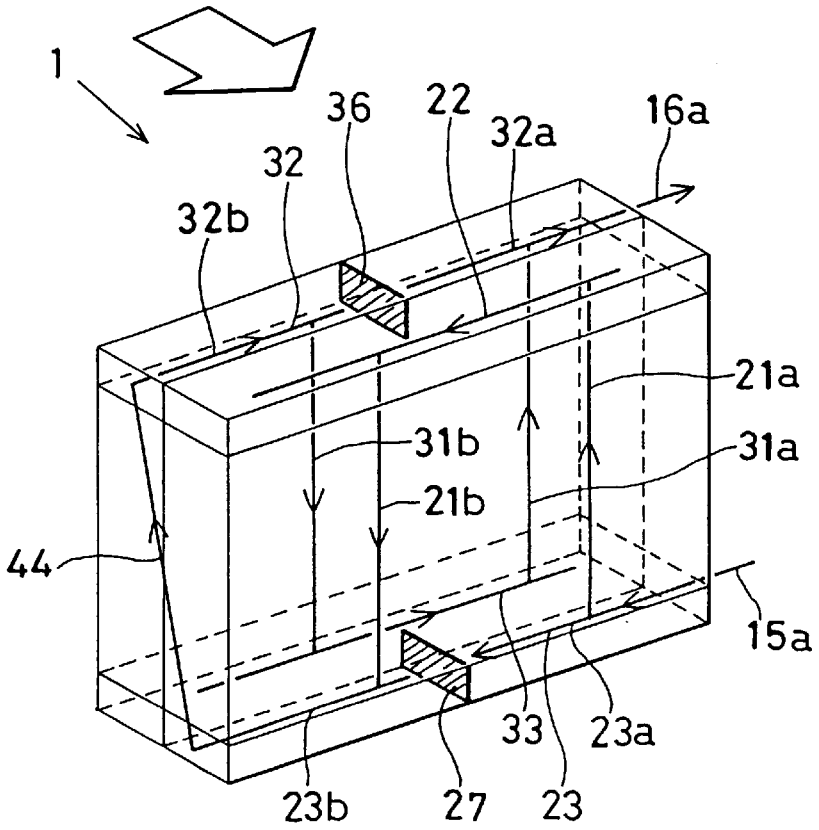
FIG. 5 is a schematic perspective view showing a refrigerant flow route in the evaporator according to the present embodiment.

Referring to FIGS. 3 and 5, an upper side inlet tank portion 22 is provided at the upper end of the air downstream side refrigerant passage 21, and a lower side inlet tank portion 23 is provided at the lower end of the air downstream side refrigerant passage 21. Whereas, an upper side outlet tank portion 32 is provided at the upper end of the air upstream side refrigerant passage 31 and a lower side outlet tank portion 33 is provided at the lower end of the air upstream side refrigerant passage 31.

In the upper side inlet tank portion 22 and the lower side inlet tank portion 23, communication holes 221 and 231 are formed respectively for communicating the air downstream side refrigerant passages 21 of each tube to each other. In the upper side outlet tank portion 32 and the lower side outlet tank portion 33, communication holes 321 and 331 are formed respectively for communicating the air upstream side refrigerant passages 31 of each tube to each other. These communication holes 221, 231, 321 and 331 are formed into an elliptical shape. The metal plate 4*a* is symmetrical in the upper and lower direction and in the right and left direction.

The plural tube elements 4 and the flat tube element 50 form the heat exchanging portions 2 and 3. The flat tube element 50 is disposed at the left end of the heat exchanging portions 2 and 3 (see FIG. 2), that is, most abutting to the refrigerant inlet and outlet pipes 15 and 16. The metal plate 4*a* and a flat plate 51 made of aluminum alloy are connected to face each other to form the flat tube element to allow the refrigerant to flow inside thereof. In the flat tube element 50, a first refrigerant passage 52 is formed at the air downstream side and a second refrigerant passage 53 is formed at the air upstream side.

In the first refrigerant passage 52 and the second refrigerant passage 53, a plurality of ribs 55 and 54 protrude from the end plate 51 in such a manner that the tops of the ribs 55 and 54 contact the opposite inside surface of the I-shaped concave portions 12 and 13 in the refrigerant passages 52 and 53. A pitch between the adjacent ribs 54, 55 is set to be about 7 mm. The ribs 55 partition the first refrigerant passage 52 into several small refrigerant passages, and the ribs 54 partition the second refrigerant passage into several small refrigerant passages. Thus, the refrigerant flow areas of the first and second refrigerant passages 52 and 53 are smaller than those of the refrigerant passages 21 and 31 in the other tube element 4. Here, the ribs 54 and 55 are formed into a rectangular shape along the longitudinal direction of the flat plate 51. However, the ribs 54 and 55 are not limited to such a shape. A cross rib for example can be applied to increase the refrigerant flow resistance. Further, the pitch between the adjacent ribs 54, 55 is not limited to 7 mm. However, it is preferable that the pitch is 10 mm or less for providing a sufficient strength of the flat tube element 50.

At both upper and lower ends of the first refrigerant passage 52, a first upper tank portion 56 and a first lower tank portion (not illustrated) are provided respectively. In a similar way, at both upper and lower ends of the second refrigerant passage 53, a second upper tank portion 57 and a second lower tank portion 58 are provided respectively.

Figure 4A:
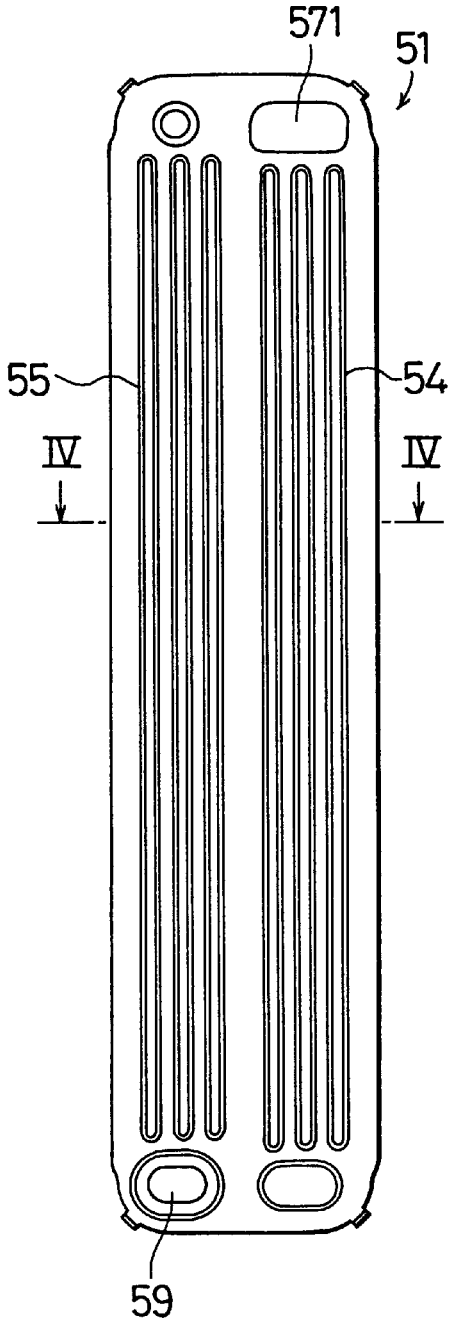
FIG. 4A is a plan view showing an end plate for forming an end tube element.
Figure 4B:
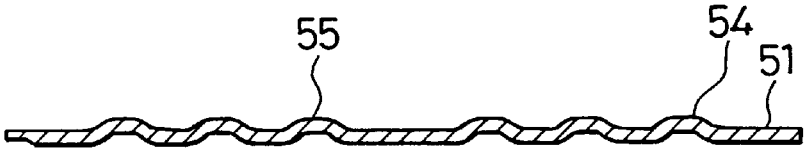
FIG. 4B is a cross sectional view taken along line IV—IV in FIG. 4A.

An ellipse-shaped opening 571 is formed at the upper side of the flat plate 51 for communicating the outlet side accumulator 16*a* to the second upper tank portion 57 (see FIG. 4). In a similar way, an ellipse-shaped opening 59 is formed at the lower side of the flat plate 51 for communicating the inlet side accumulator 15*a* to the first lower tank portion.

In the lower side inlet tank portion 23, substantially at the center in the laminating direction, a partition plate 27 is provided for partitioning the lower side inlet tank portion 23 into a first inlet tank portion 23*a* and a second inlet tank portion 23*b*. The partition plate 27 is formed by closing the communication hole 231 of the metal plate 4*a* forming the tube element 4 arranged substantially in the center of the heat exchanging portions 2 and 3. By disposing the partition plate 27, the air downstream side refrigerant passages 21 are separated into a first inlet refrigerant passage group 21*a*, where the refrigerant flows upwardly, and a second inlet refrigerant passage group 21*b*, where the refrigerant flows downwardly.

In the upper side outlet tank portion 32, substantially at the center in the laminating direction, a partition plate 36 is provided for partitioning the upper side outlet tank portion 32 into a first outlet tank portion 32*a* and a second outlet tank portion 32*b*. The partition plate 36 is formed by closing the communication hole 321 of the metal plate 4*a*. By disposing the partition plate 36, the air upstream side refrigerant passages 31 are separated into a first outlet refrigerant passage group 31*a*, where the refrigerant flows upwardly, and a second outlet refrigerant passage group 31*b*, where the refrigerant flows downwardly.

Figure 2:
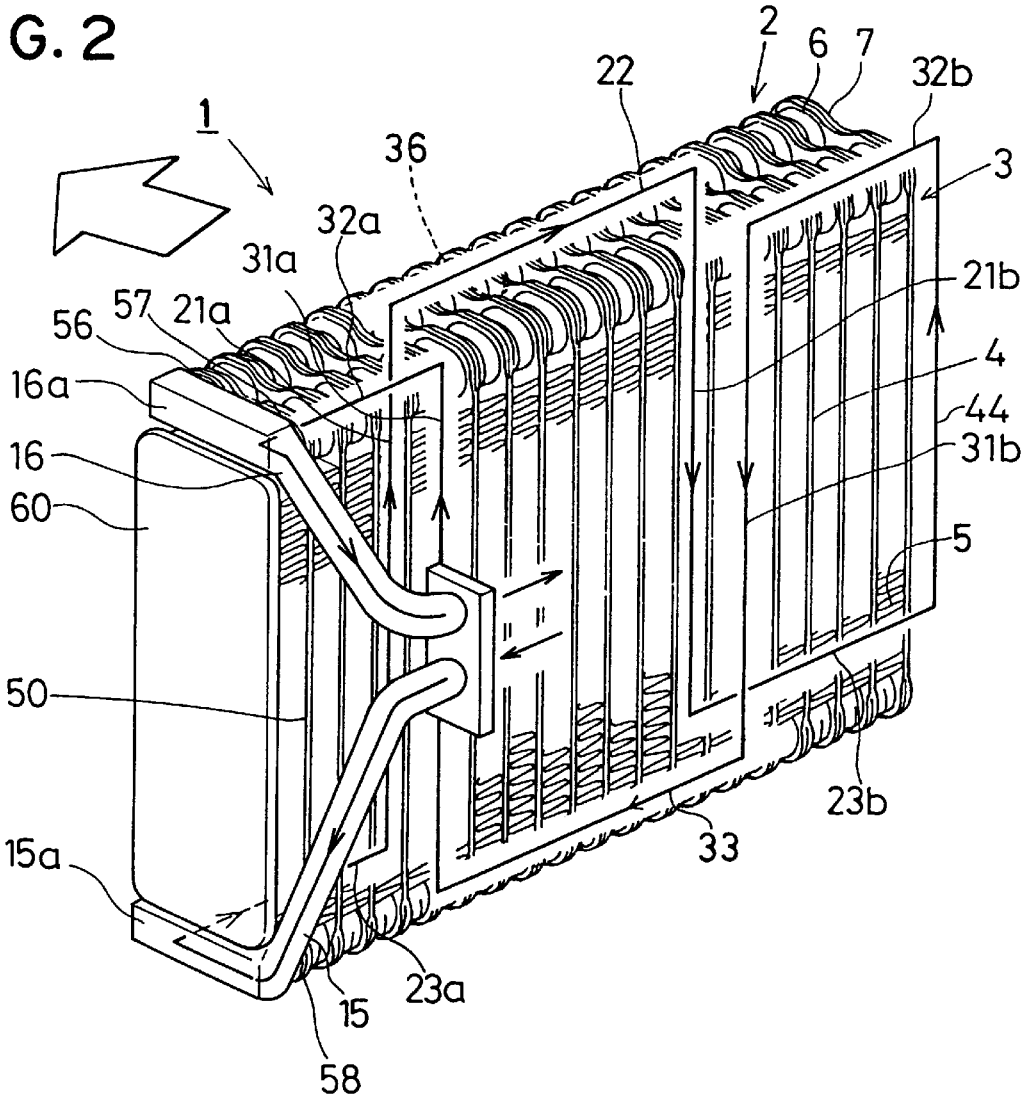
FIG. 2 is a perspective view showing a refrigerant evaporator according to the present invention.

The end plate 6 is a metal plate made of aluminum alloy that is connected to the right end of the heat exchanging portions 2 and 3 in FIG. 2. At the lower end of the end plate 6, an ellipse-shaped communication hole is formed for communicating with the lower side inlet tank portion 23. At the upper end of the end plate 6, an ellipse-shaped communication hole is formed for communicating with the upper side outlet tank portion 32.

The side plate 7 is formed by press-forming a metal plate made of aluminum alloy. Between the end plate 6 and the side plate 7, a refrigerant passage 44 is formed. The refrigerant passage 44 communicates with the second inlet tank portion 23*b* of the lower side inlet tank portion 23 to the second outlet tank portion 32*b* of the upper side outlet tank portion 32. Thus, the refrigerant flows from the lower side inlet tank portion 23 to the upper side outlet tank portion 32.

At the leftmost side of the heat exchanging portions 2 and 3 in FIG. 2, a side plate 60 formed into the same shape as the side plate 7 is connected. Between the side plate 60 and the flat tube element 50, a corrugate fin 5 is provided.

According to the above structure, the refrigerant flows inside the evaporator 1 in accordance with the flowing route: "refrigerant inlet pipe 15→first inlet tank portion 23*a*→first inlet refrigerant passage group 21*a*→upper side inlet tank portion 22→second inlet refrigerant passage group 21*b*→second inlet tank portion 23*b*→refrigerant passage 44→first outlet tank portion 32*b*→second outlet refrigerant passage group 31*b*→lower side outlet tank portion 33→first outlet refrigerant passage group 31*a*→second outlet tank portion 32*a*→refrigerant outlet pipe 16".

Next, the operation of the evaporator 1 will be explained.

The low temperature and low pressure liquid and gas phase refrigerant expanded and pressure reduced at the pressure reducing member is introduced into the first inlet tank portion 23*a* through the refrigerant inlet pipe 15. The refrigerant is distributed into the plural air downstream side refrigerant passages 21 forming the first inlet refrigerant passage group 21*a*. The refrigerant flowing in the first inlet refrigerant passage group 21*a* is heat exchanged with the air and evaporated, after that, flows into the upper side inlet tank portion 22. At this time, the dryness degree of the refrigerant is still low.

The refrigerant introduced into the upper side inlet tank portion 22 is distributed into the plural air downstream side refrigerant passages 21 forming the second inlet refrigerant passage group 21*b*. The refrigerant flowing in the second inlet refrigerant passage group 21*b* is heat exchanged with the air and evaporated. Subsequently, the evaporated refrigerant flows into the second inlet tank portion 23*b*. At this time, the dryness degree of the refrigerant increases but still remains somewhat low.

The refrigerant introduced into the second inlet tank portion 23*b* flows into the second outlet tank portion 32*b* via the refrigerant passage 44. The refrigerant introduced into the second outlet tank portion 32*b* is distributed into the plural air upstream side refrigerant passage 31 forming the second outlet refrigerant passage group 31*b*. The refrigerant flowing inside the second outlet refrigerant passage group 31*b* is heat exchanged with the air and evaporated, after that flows into the lower side outlet tank portion 33. At this time, the dryness degree of the refrigerant rises to a certain degree.

The refrigerant introduced into the lower side outlet tank portion 33 is distributed into the plural air upstream side refrigerant passages 31 forming the first outlet refrigerant passage group 31*a*. The refrigerant flowing inside the first outlet refrigerant passage group 31*a* is heat exchanged with the air and evaporated. Subsequently, the evaporated refrigerant flows into the first outlet tank portion 32*a*. At this time, the refrigerant has been evaporated completely and its dryness degree increases near 1.0.

Finally, the refrigerant introduced into the first outlet tank portion 32*a* flows out of the evaporator 1 through the refrigerant outlet pipe 16, and flows into the compressor.

Figure 9:
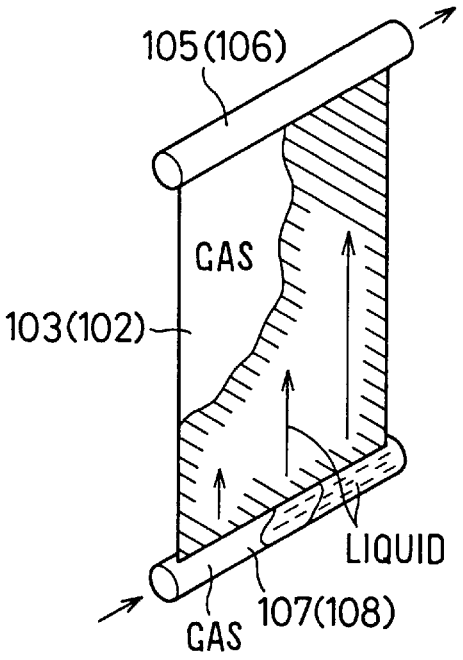
FIG. 9 RELATED ART
FIG. 9 is a schematic view showing a refrigerant distribution in a first outlet refrigerant passage group of the related art evaporator in FIG. 7.

Here, when the refrigerant flows upwardly from the lower side outlet tank portion 33 to the first outlet tank portion 32*a*, as shown in FIG. 9, the liquid phase refrigerant tends to flow into the air upstream side refrigerant passages 31 disposed in the refrigerant outlet pipe 16 side, rather than the center of the first outlet refrigerant passage group 31*b*. The gas phase refrigerant, however, tends to flow into the air upstream side refrigerant passages 31 disposed near the partition plate 36.

According to the present embodiment, the second refrigerant passage 53 formed in the flat tube element 50 is partitioned into several small refrigerant passages by the rib 54. Thus, the refrigerant flowing area of the second refrigerant passage 53 is smaller than that of the other air upstream side refrigerant passages 31. That is, the refrigerant flow resistance in the second refrigerant passage 53 is larger than that of the other air upstream side refrigerant passages 31. Thus, the refrigerant is prevented from flowing into the second refrigerant passage 53 excessively. Accordingly, the refrigerant flowing in the second refrigerant passage 53 is evaporated completely to become the super-heated gas phase refrigerant, and the temperature of the refrigerant at the outlet of the evaporator 1 is prevented from dropping. Thus, an expansion valve can control the flow amount of the refrigerant flowing into the evaporator 1, and the cooling ability of the evaporator 1 is improved. Further, as the refrigerant is distributed into the air upstream side refrigerant passages 31 in the first outlet refrigerant passage group 31*b* uniformly, the temperature distribution of the air passing through the evaporator 1 becomes uniform.

Figure 6A:
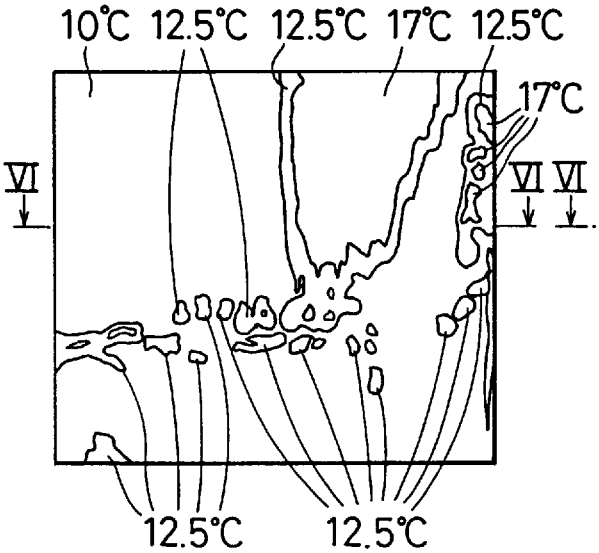
FIG. 6A shows an air temperature distribution at the air downstream side of the evaporator according to the present embodiment.
Figure 6B:
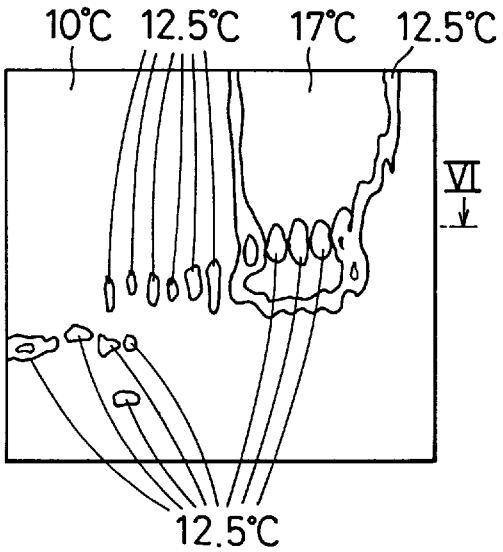
FIG. 6B shows an air temperature distribution at the air downstream side of the evaporator according to prior application.
Figure 6C:
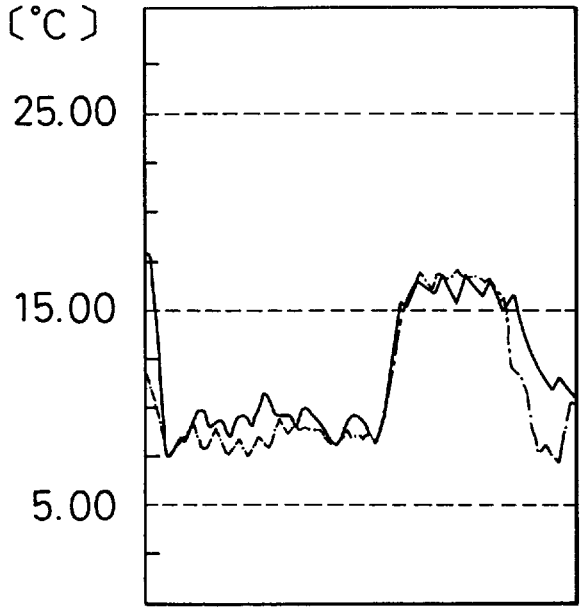
FIG. 6C shows an air temperature distribution in the position taken along a line VI—VI in FIGS. 6A and 6B.
Figure 7:
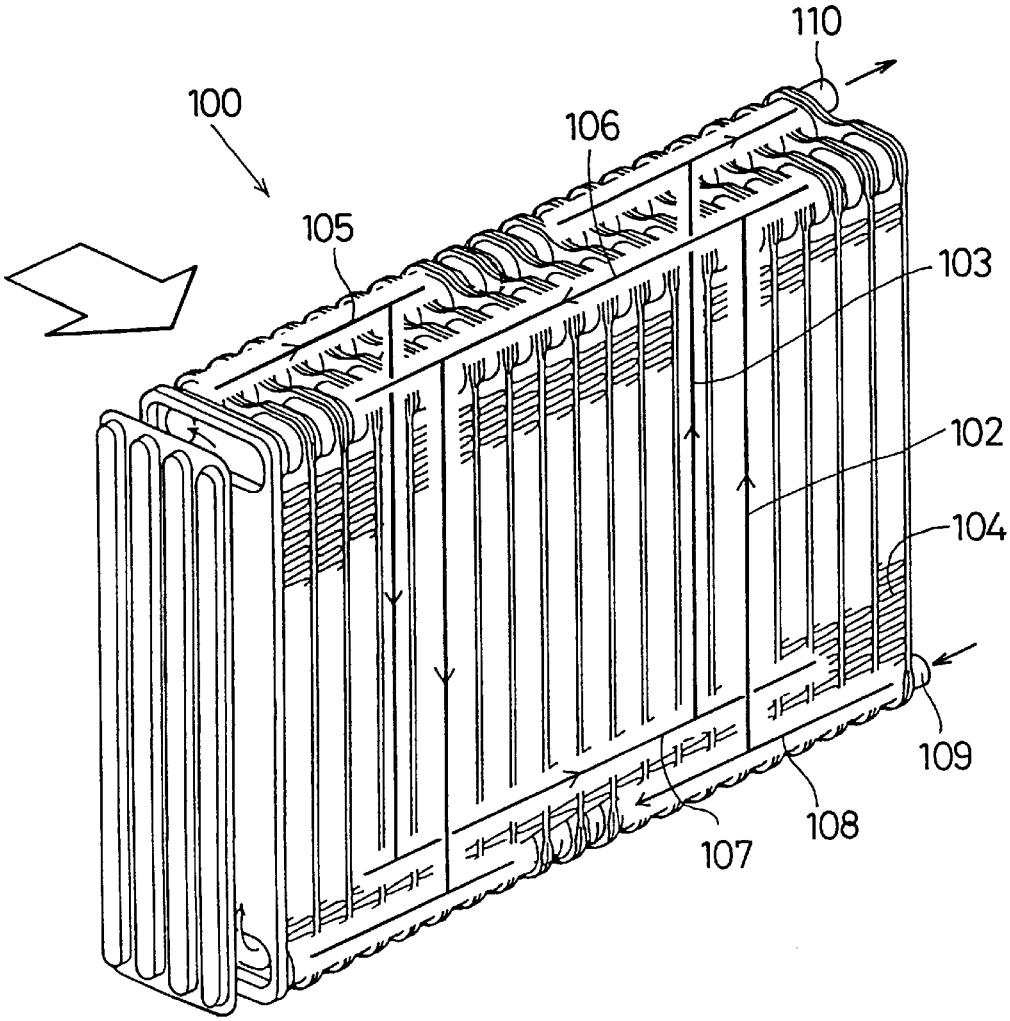
FIG. 7 RELATED ART
FIG. 7 is a perspective view showing a related art refrigerant evaporator.
Figure 8:
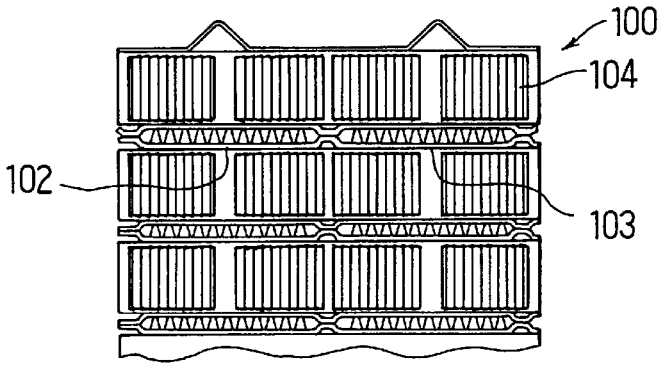
FIG. 8 RELATED ART
FIG. 8 is a cross sectional view showing a principal part of the related art evaporator in FIG. 7.

FIG. 6A shows the distribution test result of the air temperature at the air downstream side of the evaporator 1 in the present embodiment. FIG. 6B shows the distribution test result of the air temperature at the air downstream side of the conventional evaporator disclosed in the prior application. The dimension and structure of the evaporator of FIGS. 6A and 6B correspond to those of the air downstream side heat exchanging portion 2 of the evaporator 1 in FIG. 2. In FIG. 6C, a solid line denotes the air temperature distribution in the position taken along a line IV—IV in FIG. 6A, and a one dotted chain line denotes the air temperature distribution of the position taken along a line IV—IV in FIG. 6B. Here, as an experimental condition, the temperature of the air passing through the evaporator is 27° C., the humidity thereof is 50%, and the flow amount thereof is 450 $m^3$/h.

As shown in FIG. 6A, at the refrigerant outlet pipe 16 side (the right side in FIG. 6A) of the evaporator 1 in the present embodiment, a low temperature (10° C.) area is larger than that of the conventional evaporator. As is understood from this test result, the heat exchanging efficiency is improved.

According to the preset embodiment, the refrigerant flow resistance in the second refrigerant passage 53 is set to be larger than that in the other refrigerant passages 21 and 31 due to the ribs 54 on the flat plate 51. Therefore, an additional element is not needed to increase the refrigerant flow resistance in the second refrigerant passage 53, and the cost of manufacturing can be reduced.

The outer shape of the flat tube element 50 is different, and thus distinguishable, from that of the tube element 4. Thus, the tube elements 4 and the flat tube element 50 can be correctly positioned during assembly.

In the above-described embodiment, the ribs 55, 54 are formed in both the first refrigerant passage 52 and the second refrigerant passage 53. However, it should be noted that the refrigerant flow resistance needs to be increased in only the second refrigerant passage 53 which abuts the refrigerant outlet pipe 16. The rib 54 may thus be formed in only the second refrigerant passage 53 to attain the object of the present invention.

According to the present embodiment, the flat tube element 50 may be disposed at a most-abutting position relative to the refrigerant outlet pipe 16. However, the position of the flat tube element 50 is not limited to the above position. That is, disposing the flat tube element 50 at the refrigerant outlet pipe 16 side rather than the center of the first outlet refrigerant passage group 31*a* is possible. For example, the flat tube element 50 can be disposed at the second or third most abutting position relative to the refrigerant outlet pipe 16. Further, disposing plural flat tube elements 50 in the refrigerant outlet pipe 16 side rather than the center of the first outlet refrigerant passage group 31*a* is possible.

The refrigerant flowing route in the heat exchanging portions 2 and 3 is not limited to the above embodiment as shown in FIG. 5, and many modifications can be applied.

What is claimed is:

1. A refrigerant evaporator comprising:

a plurality of tubes arranged in parallel to form a refrigerant passage, each tube of said plurality of tubes being constructed by a pair of metal plates connected to face each other;

an inlet tank portion provided at a lower end of said each tube for distributing the refrigerant into said refrigerant passage;

an outlet tank portion provided at an end of said each tube for receiving the refrigerant; and a refrigerant outlet pipe connected to one end of said outlet tank portion, wherein in at least one of said refrigerant passages disposed in the vicinity of said refrigerant outlet pipe, a rib is formed for decreasing a refrigerant flow area inside said refrigerant passage.

2. A refrigerant evaporator according to claim 1, wherein said rib is formed in at least one of said refrigerant passages disposed in said refrigerant outlet pipe side rather than a center of said outlet tank portion in its longitudinal direction.

3. A refrigerant evaporator according to claim 1, wherein said outlet tank portion is disposed at an upper end of said each tube so that the refrigerant flows up inside said refrigerant passage.

4. A refrigerant evaporator according to claim 1, wherein said rib is formed in the refrigerant passage disposed at a position being closest to said refrigerant outlet pipe.

5. A refrigerant evaporator according to claim 1, wherein said rib protrudes from a flat plate connected to said metal plate for forming a refrigerant passage whose refrigerant flow area is decreased.

6. A refrigerant evaporator comprising:

a plurality of tubes arranged in parallel, in which an inlet side refrigerant passage and an outlet side refrigerant passage are formed, each tube of said plurality of tubes being constructed by a pair of metal plates to face each other;

an upper side inlet tank portion provided at an upper end of said each tube which communicates with said inlet side refrigerant passage;

a lower side inlet tank portion provided at a lower end of said each tube which communicates with said inlet side refrigerant passage;

an upper side outlet tank portion provided at the upper end of said each tube which communicates with said outlet side refrigerant passage;

an lower side outlet tank potion provided at the lower end of said each tube which communicates with said outlet side refrigerant passage;

a refrigerant inlet pipe connected to an end of said lower side inlet tank portion for introducing the refrigerant into said lower side inlet tank portion;

a refrigerant outlet pipe connected to an end of said upper side outlet tank portion, through which the refrigerant flows out of said upper side outlet tank portion;

a first partition plate provided in said lower side inlet tank portion for separating said inlet side refrigerant passages into a first inlet side refrigerant passage group and a second inlet side refrigerant passage group;

a second partition plate provided in said upper side outlet tank portion for separating said outlet side refrigerant passages into a first outlet side refrigerant passage group and a second outlet side refrigerant passage group; and a refrigerant passage for communicating said lower side inlet tank portion to said upper side outlet tank portion, wherein among said outlet refrigerant passages forming said first outlet refrigerant passage group, in at least one of said outlet side refrigerant passages which are disposed in the vicinity of said refrigerant outlet pipe, a rib is formed for decreasing a refrigerant flow area inside said tube.

7. A refrigerant evaporator according to claim 6, wherein said rib is formed in at least one of said outlet side refrigerant passages disposed in said refrigerant outlet pipe side rather than a center of said first outlet refrigerant passage group.

8. A refrigerant evaporator according to claim 6, wherein said rib is formed in the outlet side refrigerant passage which is disposed at a position being closest to said refrigerant outlet pipe.

9. A refrigerant evaporator according to claim 6, wherein said refrigerant inlet pipe is connected to the end of said lower side inlet tank portion through an inlet side accumulator, and said refrigerant outlet pipe is connected to the end of said upper outlet tank portion through an outlet side accumulator.

* * * * *